United States Patent [19]

Larsson et al.

[11] 4,385,878

[45] May 31, 1983

[54] APPARATUS FOR MANUFACTURING A METAL POWDER BY GRANULATION OF A METAL MELT

[75] Inventors: Hans G. Larsson; Erik Westman, both of Västeras, Sweden

[73] Assignee: ASEA Aktiebolag, Västeras, Sweden

[21] Appl. No.: 113,309

[22] Filed: Jan. 18, 1980

Related U.S. Application Data

[62] Division of Ser. No. 58,766, Jul. 19, 1979, abandoned.

[30] Foreign Application Priority Data

Jul. 21, 1978 [SE] Sweden ..... 7808028

[51] Int. Cl.[3] ..... B01J 2/02

[52] U.S. Cl. ..... 425/7; 264/12

[58] Field of Search ..... 425/7; 264/12

[56] References Cited

U.S. PATENT DOCUMENTS 1,356,780 10/1920 Nicol ..... 264/12
2,638,626 5/1953 Golwynne ..... 425/7
4,011,290 3/1977 Blomqvist et al. ..... 425/7
4,080,126 3/1978 Clark et al. ..... 425/7

*Primary Examiner*—James R. Hall
*Attorney, Agent, or Firm*—Watson, Cole, Grindle & Watson

[57] ABSTRACT

An apparatus for granulating a metal melt which comprises a closed housing having a granulating section and a collecting section for the collection of manufactured powder, the granulating including a casting box and one or more primary nozzles which form decomposing, groove-shaped gas jets which impinge against the stream of metal melt falling from the casting box to form droplets which are then thrown in a parabolic trajectory into the collecting section. The apparatus further includes one or more secondary nozzles producing one or more auxiliary gas jets which are used to increase the breakdown or granulating effect of the groove-shaped gas jets, to control the trajectory of the formed droplets in the collecting section of the housing and to prevent the eddying of the formed droplets towards the primary nozzles from which the groove-shaped gas jets emanate.

6 Claims, 7 Drawing Figures

FIG. 3
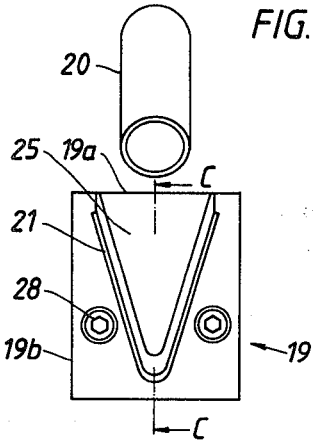
FIG. 4
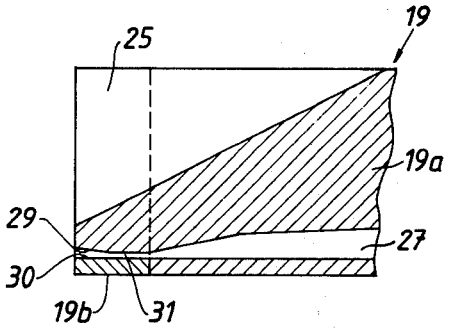
FIG. 5
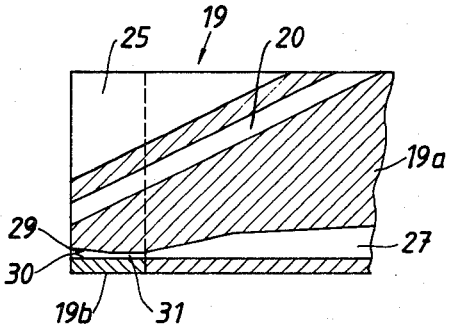
FIG. 6
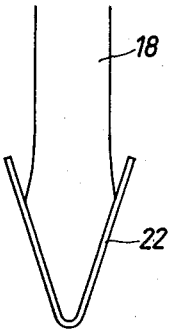
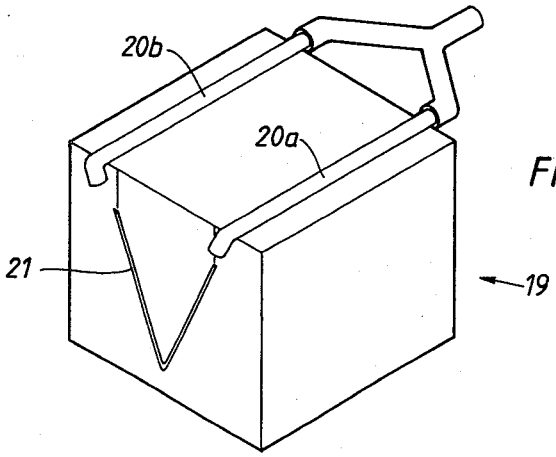
FIG. 7

APPARATUS FOR MANUFACTURING A METAL POWDER BY GRANULATION OF A METAL MELT

This application is a divisional application of application Ser. No. 58,766, filed July 19, 1979, now abandoned.

BACKGROUND OF THE INVENTION

The present invention relates to an apparatus for manufacturing a metal powder by the granulation of a metal melt. The metal melt in the form of one or more vertical tap streams is caused to fall down against one or more impacting streams of gas having a high velocity and is broken down or granulated by the gas into fine droplets which rapidly solidify into a powder so that the fine structure of the droplets is maintained in the powder after solidification.

The apparatus according to the present invention can be used for the granulation of all types of metallic material, but it is primarily intended for the manufacture of steel powder having a high content of alloying materials, for example, high-speed steel, or for the manufacture of superalloy powders. The above-mentioned alloys are quite difficult to manufacture by conventional casting methods due to the separation of the alloying materials, formation of segregation, deterioration of the structure by grain growth, etc., which occur upon a slow solidification of large castings.

By granulation into a powder by a jet of gas, however, rapid cooling of formed droplets can be obtained such that the temperature interval is rapidly passed where grain growth and other unfavorable structural changes take place. It is therefore possible, by hot isostatic pressing of the formed powder, to manufacture bodies in which the favorable structure in the formed powder is maintained. The following requirements regarding the properties of the powder should, if possible, be fulfilled:

(a) The powder should have a low content of impurities, above all a low oxygen content;
(b) The powder should have a spherical particulate form essentially without blisters or hollows;
(c) The powder should have a size distribution suitable with regard to the hot pressing; and
(d) The powder should have a fine microstructure.

With regard to the requirement that the powder have a low content of impurities, a pure gas with a low oxygen content or a low content of other detrimental substances must be used. Pure nitrogen gas or a pure inert gas are used for manufacturing high-speed steel powder and superalloy powder, respectively.

Facilities for the granulation of a molten metal are expensive, both in terms of initial investment and in energy consumption. The resultant high costs for manufacturing powder have to date restricted the use of hot isostatic pressing to the manufacture of bodies from powders either formed of expensive alloys (which can be manufactured with great difficulty by conventional melting processes) or which are impossible to manufacture at all.

SUMMARY OF THE INVENTION

The essence of the apparatus of the present invention is that, by use of a more efficient shape of the gas jet, a molten metal may be granulated with less energy consumption than with previous granulation devices. Furthermore, the apparatus allows granulation to be conducted in equipment having a smaller height and therefore allows a smaller building to be used to house the equipment. In addition, the apparatus allows the use of a simpler gas circulation system and simpler transportation equipment for the melt. Consequently, the apparatus can be installed in the buildings of an already existing ironworks.

According to the present invention, one or more gas jets having a grooved-shaped, and preferably a V-shaped, cross-section directed to impact against a vertical tap stream of molten metal at a high velocity from the side, thereby breaking down the stream and projecting the formed droplets to the side in a substantially parabolic trajectory. Each such gas jet will be directed to intersect the tap stream such that its plane of symmetry will cross in or near the center line of the tap stream. The angle between the the gas and the metal stream may vary between wide limits. For example, the gas jet may be directed substantially horizontally, i.e., the angle between the gas jet and the metal stream may be 90°. Preferably, however, the angle will be between about 45° and 135°, most preferably between about 60° and 100°.

An auxillary gas jet may be obliquely directed downwardly towards the center of the groove-shaped jet and towards the tap stream of the molten melt. The auxillary jets will have the same general direction, i.e., it will be directed towards the same side of the tap stream of melt. The auxillary jet will be advantageously directed towards the point of intersection between the the groove-shaped jet and the center of the tap stream so that the auxillary jethits the tap stream just before it is hit by the gas stream of the groove-shaped jet. As a consequence, a certain flattening or extension of the tap stream of metal melt may then occur which facilitates the granulation since a smaller number of coarse powder particles are produced. The nozzles which form the gas jets can be supplied with gas of different pressures. Control of the trajectories of the formed droplets and therefore of the formed powder can be achieved by varying the pressure (flow rate) of the gas to either of or both of the nozzles so that the strengths (flow rates) of the jets relative to one another is changed.

The apparatus for the granulation comprises a closed housing to prevent the entrance of air and a casting box located within the housing. Molten metal contained in the casting box passes through one or more tap holes down into a granulating section in the housing to form a tap stream. A primary nozzle, constructed so as to form a groove-shaped gas jet, is located in the granulating section of the housing such that the gas jet from the nozzle intersects the tap stream. The primary orifice of the nozzle is situated as close as possible to the fall path of the tap stream. Droplets and powder formed by the groove-shaped gas jet impacting the tap stream are thrown in a parabolic trajectory and are collected in a collecting section of the housing which has a shape suitable to the trajectory. The collecting section is provided with means for removing the formed powder. In addition to the primary nozzle which forms a groove-shaped gas jet, the apparatus includes a secondary nozzle to create an auxiliary gas jet directed towards the tap stream and towards the bottom of the groove-shaped gas jet. Several parallel primary nozzles may be used and each primary nozzle may be provided with one or more secondary nozzles.

The apparatus is also provided with a gas supply plant which includes a gas cleaner and a cooler for circulating gas which is to be compressed and supplied to the granulating nozzles anew. Furthermore, a casting ladle for collecting metal from the tap stream may be included in the granulating section below the casting box. The ladle is intended for the collection of molten metal in the event of operational disturbances, if any, and for the collection of the metal passing initially upon start-up which may contain impurities so that this material will not be granulated. The apparatus can also include a cooler and a conduit for the direct return of gas from the collecting section of the housing to the granulating section for use in cooling the formed droplets and the powder only. Due to the improved design of the nozzles, the amount of gas from the granulating jets may not always be sufficient to cool the formed droplets and powder to the desired temperatures.

Further objects, advantages and features of the present invention will become more fully apparent from a detailed consideration of the arrangement and construction of the constituent parts as set forth in the following specification taken together with the accompanying drawing.

DESCRIPTION OF THE DRAWING

FIG. 3 shows a view of the nozzles shown in FIG. 2 when viewed along line A—A, FIG. 4 shows a sectional view of portions of the nozzles shown in FIG. 2, as well as their relationship to a vertically descending molten metal stream, when viewed along line C—C in FIG. 3, FIG. 5 shows a sectional view through a portion of a composite nozzle which can be used in the apparatus of FIG. 1 instead of the two separate nozzles shown in FIG. 4, FIG. 6 shows a view along line B—B of FIG. 2, depicting the orientation of the groove-shaped gas jet emitted from the primary nozzle with respect to the cross section of the vertically descending stream of molten metal, FIG. 7 shows a perspective view of an alternative nozzle combination which can be used in the apparatus of FIG. 1 instead of the two nozzles shown in FIGS. 3 and 4 or the composite nozzle shown in FIG. 5.

DETAILED DESCRIPTION OF THE PREFERRED EMBODIMENTS

Figure 1:
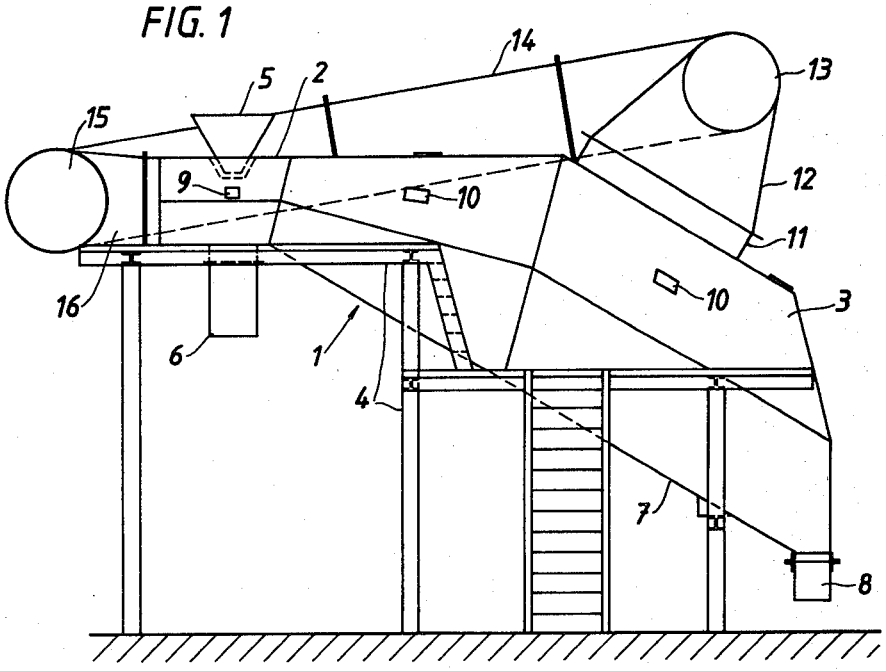
FIG. 1 shows a schematic side view of a granulating apparatus in accordance with the present invention.

As shown in FIG. 1, the apparatus in accordance with the present invention comprises a closed housing 1 having a granulating section 2 and a collecting section 3 for collection of the produced powder, the collecting section having a shape corresponding to the trajectory, indicated by arrow 100, of the formed droplets and the powder formed from the droplets. Housing 1 is elevated and supported by structure 4. Granulating section 2 is provided with a casting box 5 and a ladle 6 below the casting box. Ladle 6 is adapted to collect melt in case of operational disturbances as well as to collect melt at the start of the tapping when the melt may contain particularly large amounts of impurities. Lower wall 7 of collecting section 3 inclines downwardly, the angle of inclination being greater than the natural angle of repose of the formed powder. The powder produced in the apparatus is collected in the container 8.

Housing 1 is also provided with an inspection window 9 in one side wall of the granulating section 2 directly in front of the nozzles 19,20 and the tap stream from box 5, and with inspection windows 10 in one side wall of the collecting section 3. In the upper wall of the collecting section 3 an outlet opening is located for removal of used gas. Cooler 11 is connected to this outlet for cooling gas which has been heated during the granulation process. A portion of the gas is returned through the conduits 12, 13, 14, 15 and 16 to the granulating section 2. Another portion of the gas is sucked through a cleaning filter (not shown) to a compressor (not shown) which supplies the granulating nozzles of the apparatus.

Figure 2:
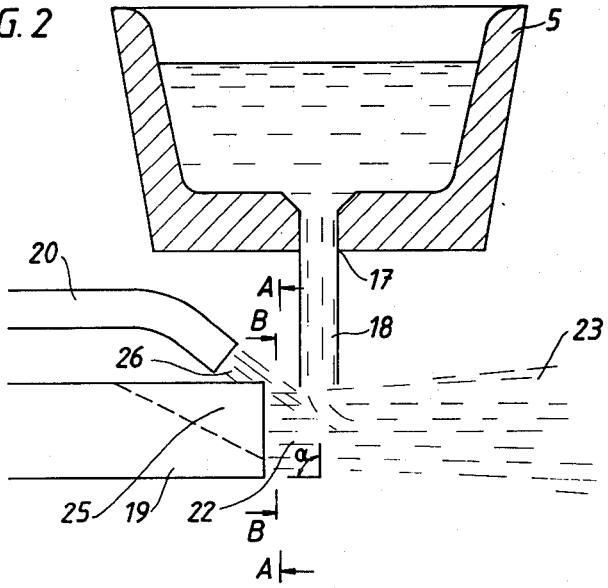
FIG. 2 shows an enlarged schematic side view of the part of the apparatus in FIG. 1 which produces the metal droplets from a vertically descending molten metal stream according to the present invention, this part including one embodiment of a primary nozzle for emitting a groove-shaped gas jet and one embodiment of a secondary nozzle for emitting an associated auxiliary gas jet.

FIG. 2 shows the casting box 5 containing molten metal in greater detail. The bottom of casting box 5 is provided with a tap opening 17 where the downwardly flowing tap stream 18 is formed. Primary nozzle 19 and secondary nozzle 20 are located to one side of tap stream 18. Primary nozzle 19 has V-shaped discharge orifice 21 forming V-shaped gas jet 22 which breaks up tap stream 18 into droplets which are rapidly cooled and form powder 23 which is thrown into collecting section 3 of housing 1 in a parabolic trajectory. The angle between the upwardly extending portions of the V-shaped gas jet 22 may be between 15° and 60°. Normally, an acute angle is the most favorable. Since gas jet 22 is V-shaped, two elliptic intersecting surfaces are obtained when the gas jet hits tap stream 18. Gas jet 22 then acquires a large effective width and therefore has good ability to break up tap stream 18 into small powder droplets. The angle $\alpha$ between the direction **22*a* of the flow of the V-shaped gas jet 22 and the vertical center line 18*a* of tap stream 18 may be between 45° and 135°, and preferably will be between about 60° and 100°. Primary nozzle 19 is formed with an indentation 25 on its upper side and secondary nozzle 20 is directed so that it blows an auxiliary jet 26 downwardly into this indentation and into the channel of formed gas jet 22. Secondary nozzle 20 is also directed such that auxiliary gas jet 26 hits tap stream 18**.

As is shown in FIGS. 3 and 4, primary nozzle 19 which forms V-shaped gas jet 22 may, for example, be composed of first member **19*a* having supply channel 27 for gas and second member 19*b* which is joined to the first member by bolts 28. Members 19*a* and 19*b* are formed so that channel 31 with an outwardly increasing width is formed between walls 29 and 30. Nozzle 19 is therefore of the so-called De Laval design which efficiently utilizes the energy in the pressure gas and gives the gas jet a very high velocity and a high energy content. Member 19*b* in nozzle 19 may be vertically displaceable in relation to the member 19*a* so that the width of the channel, and thus the thickness of the gas jet issuing therefrom can be varied. It can be seen that a downwardly sloping V-shaped indentation 25 is located in the top surface of first member 19*a***.

Secondary nozzle 20 supplies gas to indentation 25 near the orifice of primary nozzle 19 so that the negative pressure caused by the ejector effect is eliminated and the molten tap stream 18 is prevented from eddying towards the orifice of the nozzle 19. In this manner, the metal droplets from tap stream 18 are prevented from coming into contact with primary nozzle 19 and being deposited at the opening of the nozzle and unfavorably influencing the shape characteristics of the nozzle, or completely clogging the nozzle. The clearing effect of the auxiliary jet 26 from secondary nozzle 20 allows primary nozzle 19 to be located nearer tap stream 18 and thus less energy is lost in the V-shaped gas jet 22 before the V-shaped jet hits the side of tap stream 18. Consequently, a better atomization of the metal can be obtained which will yield upon cooling a better metal powder having a reduced quantity of coarse powder grains (which otherwise would have to be separated out). A corresponding supply of gas at the other sides of primary nozzle 19 may also be favorable.

Auxillary gas jet 26 from secondary nozzle 20 also has another important effect. By altering the pressure of the supplied gas and thus the velocity and the amount of gas in auxillary gas jet 26, the trajectory for the formed powder can be influenced so that the trajectory acquires a suitable shape relative to the shape of collecting section 3, thereby influencing the time it takes the formed powder to reach the bottom of section 3 and thus the degree to which the powder grains will be cooled when they are caused to come in contact one another. This will thus influence the degree to which the powder grains will possibly stick together.

As shown in FIG. 5, a single nozzle 19' can replace individual nozzles 19 and 20, nozzle 19' including a first member **19*a*' and second member 19*b*', these elements corresponding to the first and second members 19*a* and 19*b* of the nozzle 19 in FIG. 4. The first member 19*a*' includes a flow channel 27' and, together with the second member 19*b*', defines a flow channel 31' with walls 29' and 30' similar to flow channel 27, flow channel 31 and walls 29 and 30 in FIG. 4. In addition, first member 19*a*' includes an upper channel 20' which is equivalent to the flow channel defined by nozzle 20 in FIG. 4. An indentation 25' is formed in the top surface of first member 19*a*' similarly to indentation 25 in the first member 19*a* in FIG. 4**.

FIG. 6 clearly shows that the V-shaped gas jet will have a very great effective width relative to tap stream 18 and that the axis of symmetry **22*a* will be aligned with the vertical center line 18*a* of the tap stream 18**.

As shown in FIG. 7, the nozzle 19 as shown in FIGS. 3 and 4 can be replaced with a nozzle 40 which is composed of a first member 41 and a second member 42. The first member 41 does not include any indentation in its upper surface similar to indentation 25 in nozzle 19, while the second member 42 is movable with respect to first member 41 via bolts 28'. Furthermore, the secondary nozzle 20 as shown in FIGS. 3 and 4 can be replaced with twin nozzles **20*a* and 20*b* which will direct auxiliary gas jets downwardly towards one another, yet away from the front face 40*a* of the nozzle 40**.

In operation of the apparatus, the shape of V-shaped gas jet makes it possible to break up tap stream 18 with a smaller amount of gas than in previously known methods and jet shapes. The energy consumption for the gas compression is therefore considerably reduced, and of course the size of the cleaners (not shown) used in cleaning the gas taken from housing 1 is also reduced. Since the amount of gas required for solidification of the formed droplets into solid powder is greater than the amount of gas which is consumed by nozzles 19 and 20, a certain portion of the quantity of gas which is taken out from collecting section 3 through cooler 11 is returned without cleaning to granulating section 2 of housing 1 through ducts 12, 13, 14, 15 and 16. As is apparent from FIG. 1, primary nozzle 19 will be located in the current of cooling air. With a suitable location of primary nozzle 19 in granulating section 2 and a suitable shape of its cross-section, a considerable driving force for the cooling air current can be obtained. This ejector effect, either alone or in combination with a fan (not shown), is able to cause the circulation of the gas required for the cooling of the droplets and the powder.

By the present invention, it has become possible to construct a granulating apparatus with a relatively small height since the groove shape of the gas jet can cause a tap stream to be directly broken up into droplets which form the powder of a practical size. Some previously used efficient granulating apparatus using a gas as the granulating medium have required cooling towers with a height of six meters or more. Such a relative large height for the apparatus has necessitated particularly high buildings to house the apparatus and corresponding high costs as well as expensive means for the vertical transportation of the raw metal materials used in the apparatus. In contrast, the granulating apparatus according to the present invention can be contained in a housing having a height of only about three meters which may provide considerable savings in the construction of a new building to house the apparatus. Perhaps more importantly, the apparatus in general can be installed in an existing building of a steelworks and existing melting plants and the means of transportation available therein can be easily utilized which thereby results in considerably lower costs when changing to powder manufacture according to the invention.

While the present invention has been described with reference to particular embodiments thereof, it will be understood that numerous modifications may be made by those skilled in the art without actually departing from the spirit and scope of the invention as defined in the appended claims.

We claim:

1. An apparatus for granulating a molten metal comprising (a) a closed housing forming a granulating section and a collecting section;

(b) a casting box having a bottom orifice positioned in said granulating section and containing the molten metal, such that at least one tap stream of falling molten metal is discharged from said orifice;

(c) at least one primary gas ejector means having a groove-shaped discharge orifice positioned in said granulating section such that a groove-shaped gas jet issuing therefrom will intersect the side of a tap stream at a high velocity and produce droplets of the molten metal which will be projected towards and into said collecting section wherein the will become cooled and form solid metal granules, (d) at least one secondary gas ejector means positioned in said granulating section for issuing one or more auxiliary gas jets directed in the same general direction and obliquely downwardly toward the bottom of a groove-shaped gas jet issuing from an associated primary gas ejector means and toward an associated tap stream;

(e) recovery means positioned in said collecting section for removing the solid metal granules produced therein; and (f) gas supply means for supplying gas to said primary and secondary gas ejector means.

2. An apparatus according to claim 1 wherein a ladle is included in the granulation section of the closed housing for collecting the molten metal at the start of the tapping and in case of interruption of the gas supply to the primary and secondary gas ejection means.

3. An apparatus according to claim 1 further including a gas return duct for recirculating gas from the collecting section of the closed housing to the granulating section and a cooler means arranged to cool the gas circulating through the closed housing and the gas return duct.

4. An apparatus according to claim 1 wherein the primary gas ejector means is in the form of a primary nozzle formed of a first, upper member and a second, lower member, the groove-shaped orifice being formed therebetween, and the first, upper member being movable with respect to the second, lower member to change the thickness of the groove-shaped gas jet issuing therefrom.

5. An apparatus according to claim 4 wherein the first, upper member includes a top surface formed with a downwardly sloping V-shaped indentation and the secondary gas ejector means is positioned to discharge a gas stream into said indentation.

6. An apparatus according to claim 1 wherein the primary and secondary gas ejector means comprises a single nozzle having upper and lower flow channels formed therein.

* * * * *